US009037457B2

(12) United States Patent
Geiger et al.

(10) Patent No.: US 9,037,457 B2
(45) Date of Patent: May 19, 2015

(54) AUDIO CODEC SUPPORTING TIME-DOMAIN AND FREQUENCY-DOMAIN CODING MODES

(71) Applicant: Fraunhofer-Gesellschaft zur Foerderung der angewandten Forschung e.V., Munich (DE)

(72) Inventors: Ralf Geiger, Erlangen (DE); Konstantin Schmidt, Nurnberg (DE); Bernhard Grill, Lauf (DE); Manfred Lutzky, Nuremberg (DE); Michael Werner, Erlangen (DE); Marc Gayer, Erlangen (DE); Johannes Hilpert, Nuremberg (DE); Maria L. Valero, Erlangen (DE); Wolfgang Jaegers, Erlangen (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 13/966,048

(22) Filed: Aug. 13, 2013

(65) Prior Publication Data

US 2013/0332174 A1 Dec. 12, 2013

Related U.S. Application Data

(63) Continuation of application No. PCT/EP2012/052461, filed on Feb. 14, 2012.

(60) Provisional application No. 61/442,632, filed on Feb. 14, 2011.

(51) Int. Cl.
*G10L 19/00* (2013.01)
*G10L 21/00* (2013.01)
(Continued)

(52) U.S. Cl.
CPC ..... *G10L 19/00* (2013.01); *G10L 19/012* (2013.01); *G10K 11/16* (2013.01); *G10L 19/04* (2013.01);
(Continued)

(58) Field of Classification Search
USPC ..... 704/200–230, 500–504
See application file for complete search history.

(56) References Cited

U.S. PATENT DOCUMENTS 5,414,796 A 5/1995 Jacobs et al.
5,537,510 A 7/1996 Kim
(Continued)

FOREIGN PATENT DOCUMENTS

AU 2007/312667 A1 4/2008
CN 1274456 A 11/2000
(Continued)

OTHER PUBLICATIONS

3GPP, "Audio codec processing functions; Extended Adaptive Multi-Rate—Wideband (AMR-WB+) codec; Transcoding functions," 2009, 3GPP TS 26.290.
(Continued)

*Primary Examiner* — Jesse Pullias
(74) *Attorney, Agent, or Firm* — Squire Patton Boggs (US) LLP

(57) ABSTRACT

An audio codec supporting both, time-domain and frequency-domain coding modes, having low-delay and an increased coding efficiency in terms of iterate/distortion ratio, is obtained by configuring the audio encoder such that same operates in different operating modes such that if the active operative mode is a first operating mode, a mode dependent set of available frame coding modes is disjoined to a first subset of time-domain coding modes, and overlaps with a second subset of frequency-domain coding modes, whereas if the active operating mode is a second operating mode, the mode dependent set of available frame coding modes overlaps with both subsets, i.e. the subset of time-domain coding modes as well as the subset of frequency-domain coding modes.

17 Claims, 6 Drawing Sheets

(51) Int. Cl.

| | |
|---|---|
| ***G10L 19/02*** | (2013.01) |
| ***G10L 19/012*** | (2013.01) |
| ***G10K 11/16*** | (2006.01) |
| ***G10L 19/005*** | (2013.01) |
| ***G10L 19/12*** | (2013.01) |
| ***G10L 19/03*** | (2013.01) |
| ***G10L 19/22*** | (2013.01) |
| *G10L 19/04* | (2013.01) |
| *G10L 25/06* | (2013.01) |
| *G10L 19/025* | (2013.01) |
| *G10L 19/107* | (2013.01) |

(52) U.S. Cl.

CPC ..... *G10L 19/005* (2013.01); *G10L 19/12* (2013.01); *G10L 19/0212* (2013.01); *G10L 19/03* (2013.01); *G10L 25/06* (2013.01); *G10L 19/025* (2013.01); *G10L 19/107* (2013.01); *G10L 19/22* (2013.01)

(56) References Cited

U.S. PATENT DOCUMENTS

| | | | | |
|---|---|---|---|---|
| 5,606,642 | A * | 2/1997 | Stautner et al. | 704/205 |
| 5,754,733 | A | 5/1998 | Gardner et al. | |
| 5,848,391 | A * | 12/1998 | Bosi et al. | 704/200.1 |
| 5,953,698 | A | 9/1999 | Hayata | |
| 5,960,389 | A | 9/1999 | Jarvinen et al. | |
| 5,982,817 | A | 11/1999 | Wuppermann | |
| 6,070,137 | A * | 5/2000 | Bloebaum et al. | 704/227 |
| 6,134,518 | A | 10/2000 | Cohen et al. | |
| 6,236,960 | B1 | 5/2001 | Peng et al. | |
| 6,317,117 | B1 | 11/2001 | Goff | |
| 6,532,443 | B1 | 3/2003 | Nishiguchi et al. | |
| 6,757,654 | B1 | 6/2004 | Westerlund et al. | |
| 6,879,955 | B2 | 4/2005 | Rao | |
| 7,124,079 | B1 | 10/2006 | Johansson et al. | |
| 7,280,959 | B2 | 10/2007 | Bessette | |
| 7,343,283 | B2 | 3/2008 | Ashley et al. | |
| 7,363,218 | B2 | 4/2008 | Jabri et al. | |
| 7,519,535 | B2 | 4/2009 | Spindola | |
| 7,519,538 | B2 | 4/2009 | Villemoes et al. | |
| 7,536,299 | B2 | 5/2009 | Cheng et al. | |
| 7,610,197 | B2 | 10/2009 | Cruz-Zeno et al. | |
| 7,707,034 | B2 | 4/2010 | Sun et al. | |
| 7,747,430 | B2 | 6/2010 | Makinen | |
| 7,873,511 | B2 | 1/2011 | Herre et al. | |
| 7,933,769 | B2 | 4/2011 | Bessette | |
| 7,979,271 | B2 | 7/2011 | Bessette | |
| 7,987,089 | B2 | 7/2011 | Krishnan et al. | |
| 8,121,831 | B2 * | 2/2012 | Oh et al. | 704/219 |
| 8,160,274 | B2 | 4/2012 | Bongiovi | |
| 8,255,207 | B2 | 8/2012 | Vaillancourt et al. | |
| 8,428,936 | B2 | 4/2013 | Mittal et al. | |
| 8,566,106 | B2 | 10/2013 | Salami et al. | |
| 8,630,862 | B2 | 1/2014 | Geiger et al. | |
| 8,630,863 | B2 | 1/2014 | Son et al. | |
| 2002/0078771 | A1 | 6/2002 | Kreichauf et al. | |
| 2002/0111799 | A1 | 8/2002 | Bernard | |
| 2002/0184009 | A1 | 12/2002 | Heikkinen | |
| 2003/0009325 | A1 | 1/2003 | Kirchherr et al. | |
| 2003/0078771 | A1 | 4/2003 | Jung et al. | |
| 2004/0225505 | A1 | 11/2004 | Andersen et al. | |
| 2005/0091044 | A1 | 4/2005 | Ramo et al. | |
| 2005/0130321 | A1 | 6/2005 | Nicholson et al. | |
| 2005/0131696 | A1 | 6/2005 | Wang et al. | |
| 2005/0154584 | A1 | 7/2005 | Jelinek et al. | |
| 2005/0240399 | A1 | 10/2005 | Makinen | |
| 2005/0278171 | A1 | 12/2005 | Suppappola et al. | |
| 2006/0206334 | A1 | 9/2006 | Kapoor et al. | |
| 2006/0271356 | A1 | 11/2006 | Vos | |
| 2006/0293885 | A1 | 12/2006 | Gournay et al. | |
| 2007/0016404 | A1 | 1/2007 | Kim et al. | |
| 2007/0050189 | A1 | 3/2007 | Cruz-Zeno et al. | |
| 2007/0100607 | A1 | 5/2007 | Villemoes | |
| 2007/0147518 | A1 | 6/2007 | Bessette | |
| 2007/0171931 | A1 | 7/2007 | Manjunath et al. | |
| 2007/0225971 | A1 | 9/2007 | Bessette | |
| 2007/0253577 | A1 | 11/2007 | Yen et al. | |
| 2007/0282603 | A1 | 12/2007 | Bessette | |
| 2008/0010064 | A1 | 1/2008 | Takeuchi et al. | |
| 2008/0015852 | A1 | 1/2008 | Kruger et al. | |
| 2008/0027719 | A1 | 1/2008 | Kirshnan et al. | |
| 2008/0052068 | A1 | 2/2008 | Aguilar et al. | |
| 2008/0137881 | A1 | 6/2008 | Bongiovi | |
| 2008/0147518 | A1 | 6/2008 | Haider et al. | |
| 2008/0208599 | A1 | 8/2008 | Rosec et al. | |
| 2008/0275580 | A1 | 11/2008 | Andersen | |
| 2009/0024397 | A1 | 1/2009 | Ryu et al. | |
| 2009/0204397 | A1 | 8/2009 | Drinker | |
| 2009/0226016 | A1 | 9/2009 | Fitz et al. | |
| 2010/0017200 | A1 | 1/2010 | Oshikiri et al. | |
| 2010/0063812 | A1 | 3/2010 | Gao | |
| 2010/0070270 | A1 | 3/2010 | Gao | |
| 2010/0076754 | A1 | 3/2010 | Kovesi et al. | |
| 2010/0138218 | A1 * | 6/2010 | Geiger | 704/205 |
| 2010/0198586 | A1 | 8/2010 | Edler et al. | |
| 2010/0217607 | A1 | 8/2010 | Neuendorf et al. | |
| 2011/0153333 | A1 | 6/2011 | Bessette | |
| 2011/0161088 | A1 | 6/2011 | Bayer et al. | |
| 2011/0178795 | A1 | 7/2011 | Bayer et al. | |
| 2011/0218797 | A1 | 9/2011 | Mittal et al. | |
| 2011/0218799 | A1 | 9/2011 | Mittal et al. | |
| 2011/0311058 | A1 | 12/2011 | Oh et al. | |
| 2012/0022881 | A1 | 1/2012 | Geiger et al. | |
| 2012/0226505 | A1 | 9/2012 | Lin et al. | |

FOREIGN PATENT DOCUMENTS

| | | | |
|---|---|---|---|
| CN | 1344067A | A | 4/2002 |
| CN | 1437747A | A | 8/2003 |
| CN | 101110214 | A | 1/2008 |
| CN | 101371295A | A | 2/2009 |
| CN | 101388210 | A | 3/2009 |
| CN | 101425292A | A | 5/2009 |
| CN | 101483043 | A | 7/2009 |
| CN | 101488344 | A | 7/2009 |
| CN | 101770775 | A | 7/2010 |
| EP | 0758123 | A2 | 2/1997 |
| EP | 0843301 | A2 | 5/1998 |
| EP | 1120775 | A1 | 8/2001 |
| EP | 1852851 | A1 | 11/2007 |
| EP | 2107556 | A1 | 10/2009 |
| JP | 10-214100 | A | 8/1998 |
| JP | 11-98090 | A | 4/1999 |
| JP | 2000330593 | A | 11/2000 |
| JP | 2002118517 | A | 4/2002 |
| JP | 2008261904 | A | 10/2008 |
| KR | 1020040043278 | A | 5/2004 |
| TW | 380246 | B | 1/2000 |
| TW | 469423 | B | 12/2001 |
| TW | I253057 | B | 4/2006 |
| TW | 200830277 | A | 7/2008 |
| TW | 200841743 | A | 10/2008 |
| TW | 200943279 | A | 10/2009 |
| TW | 200943792 | A | 10/2009 |
| TW | I320172 | B | 2/2010 |
| TW | 201027517 | A | 7/2010 |
| TW | 201030735 | A | 8/2010 |
| TW | 201032218 | A | 9/2010 |
| TW | 201040943 | A | 11/2010 |
| TW | 201103009 | A | 1/2011 |
| WO | WO-9510890 | A1 | 4/1995 |
| WO | WO-9629696 | A1 | 9/1996 |
| WO | WO-0075919 | A1 | 12/2000 |
| WO | WO-0165544 | A1 | 9/2001 |
| WO | WO-02101722 | A1 | 12/2002 |
| WO | WO-02101724 | A1 | 12/2002 |
| WO | WO-2004027368 | A1 | 4/2004 |
| WO | WO-2005078706 | A1 | 8/2005 |
| WO | WO-2005081231 | A1 | 9/2005 |
| WO | WO-2005112003 | A1 | 11/2005 |
| WO | WO-2006126844 | A2 | 11/2006 |
| WO | WO-2006130226 | A2 | 12/2006 |

(56) References Cited

FOREIGN PATENT DOCUMENTS

| | | | |
|---|---|---|---|
| WO | WO-2007051548 | A1 | 5/2007 |
| WO | WO-2007073604 | A1 | 7/2007 |
| WO | WO-2007083931 | A1 | 7/2007 |
| WO | WO-2007096552 | A2 | 8/2007 |
| WO | WO-2008013788 | A2 | 1/2008 |
| WO | WO-2009029032 | A2 | 3/2009 |
| WO | WO-2009077321 | A2 | 6/2009 |
| WO | WO-2010003491 | A1 | 1/2010 |
| WO | WO-2010003532 | A1 | 1/2010 |
| WO | WO-2010003563 | A1 | 1/2010 |
| WO | WO-2010003663 | A1 | 1/2010 |
| WO | WO-2010040522 | A2 | 4/2010 |
| WO | WO-2010059374 | A1 | 5/2010 |
| WO | WO-2010093224 | A2 | 8/2010 |
| WO | WO-2011006369 | A1 | 1/2011 |
| WO | WO-2011048094 | A1 | 4/2011 |
| WO | WO-2011147950 | A1 | 12/2011 |
| WO | WO-2012110481 | A1 | 8/2012 |

OTHER PUBLICATIONS

Bessette et al.; "A wideband speech and audio codec at 16/24/32 kbit/s using hybrid ACELP/TCX techniques," Speech Coding Proceedings, 1999 IEEE Workshop in Porvoo, Finland, Jun. 20-23, 1999, and Piscataway, NJ, Jun. 20, 1999.

Bessette et al.; "The Adaptive Multirate Wideband Speech Codec (AMR-WB)," *IEEE Transactions on Speech and Audio Processing*, Nov. 1, 2002; 10(8).

Makinen et al.; "AMR-WB+: a New Audio Coding Standard for 3rd Generation Mobile Audio Services," 2005 *IEEE International Conference on Acoustics, Speech, and Signal Processing*, Mar. 2005; 2:1109-1112.

Martin, Rainer; "Noise Power Spectral Density Estimation Based on Optimal Smoothing and Minimum Statistics," *IEEE Transactions on Speech and Audio Processing*, Jul. 2001; 9(5):504-512.

Neuendorf et al.; "A Novel Scheme for Low Bitrate Unified Speech and Audio Coding—MPEG RMO," *AES Convention 126*, May 2009, New York City, New York.

Neuendorf et al.; "Unified speech and audio coding scheme for high quality at low bitrates," *Acoustics, Speech and Signal Processing*, 2009. IEEE International Conference on ICASSP, Piscataway, NJ, Apr. 19, 2009; pp. 1-4.

Sjoberg et al.; "RTP Payload Format for the Extended Adaptive Multi-Rate Wideband (AMR-WB+) Audio Codec; rfc4352.txt," Jan. 1, 2006.

USAC codec (Unified Speech and Audio Codec), ISO/IEC CD 23003-3 dated Sep. 24, 2010.

Martin, Rainer; "Spectral Subtraction Based on Minimum Statistics," *Proc. EUSIPCO 94*, pp. 1182-1185.

Notification of Reasons for Refusal in co-pending Japan Patent Application No. 2013-553882 dated Aug. 13, 2014, 4 pages.

Notification of Reasons for Refusal in co-pending Japan Patent Application No. 2013-553892 dated Aug. 28, 2014, 7 pages.

Notification of Reasons for Refusal in co-pending Japan Patent Application No. 2013-553904 dated Sep. 24, 2014, 5 pages.

3GPP; "3rd Generation Partnership Project; Technical Specification Group Service and System Aspects; Audio codec processing functions; Extended AMR Wideband codec; Transcoding functions (Release 6)," *3GPP TS 26.290*, Sep. 2004; vol. 2.0.0.

Ashley et al.; "Wideband Coding of Speech Using a Scalable Pulse Codebook," Proc. *IEEE Workshop on Speech Coding*, Sep. 17, 2000; pp. 148-150.

Etsi; "Digital cellular telecommunications system (Phase 2+); Universal Mobile Telecommunications System (UMTS); LTE; Speech codec speech processing functions; Adaptive Multi-Rate—Wideband (AMR-WB) speech codec; Transcoding functions (3GPP TS 26.190 version 9.0.0 Release 9," *ETSI TS 126 190 V9.0.0*, Jan. 2010.

Ferreira, Anibal J.S.; "Combined Spectral Envelope Normalization and Subtraction of Sinusoidal Components in the ODFT and MDCT Frequency Domains," *IEEE Workshop on Applications of Signal Processing to Audio Acoustics*, 2010; pp. 51-54.

Fischer et al.; "Enumeration Encoding and Decoding Algorithms for Pyramid Cubic Lattice and Trellis Codes," *IEEE Transaction on Information Theory*, Nov. 1995; 41(6):2056-2061.

Hermansky, Hynek; "Perceptual linear predictive (PLP) analysis of speech," *J. Acoust. Soc. Amer.*, Apr. 1990; 87(4):1738-1751.

Hofbauer, Konrad; "Estimating Frequency and Amplitude of Sinusoid in Harmonic Signals—A Survey and the Use of Shifted Fourier Transforms"; *Graz University of Technology, Graz University of Music and Dramatic Arts*; Apr. 2004.

*IEEE Signal Processing Letters* Table of Contents, 2008; 15:967-975.

International Telecommunication Union; "Annex B: A silence compression scheme for G.729 optimized for terminals conforming to Recommendation V.70," *ITU-T Recommendation G.729—Annex B*; Series G: Transmission Systems and Media, Nov. 1996.

Joint Technical Committee ISO/IEC JTC 1; "Information technology—MPEG audio technologies—Part 3: Unified speech and audio coding," *ISO/IEC DIS 23003-3*, Jan. 31, 2011.

Lanciani et al.; "Subband-Domain Filtering of MPEG Audio Signals," Proc. *IEEE ICASSP*, Phoenix, Arizona, Mar. 1999; pp. 917-920.

Lauber et al.; "Error Concealment for Compressed Digital Audio," *Audio Engineering Society 111th Convention Paper 5460*, Sep. 21-24, 2001, New York City, New York.

Lee et al.; "A voice activity detection algorithm for communication systems with dynamically varying background acoustic noise," *Proc. Vehicular Technology Conference*, May 1998; vol. 2; pp. 1214-1218.

Motlicek et al.; "Audio Coding Based on Long Temporal Contexts," URL:http://www.idiap.ch/publications/motlicek-idiap-rr-06-30.bib.abs.html; *IDIAP-RR*, Apr. 2006.

Neuendorf et al.; "Completion of Core Experiment on Unification of USAC Windowing and Frame Transitions," *ISO/IEC JTC1/SC29/WG11, MPEG2010/M17167*, Jan. 2010, Kyoto, Japan.

Neuendorf, Max (editor); "WD7 of USAC," *ISO/IEC JTC1/SC29/WG11, MPEG2010/N11299*, Apr. 2010, Dresden, Germany.

Notification of Reason for Rejection in co-pending Japan Patent Application No. 2013-553881 dated Aug. 20, 2014, 3 pages.

Notification of Reason for Rejection in co-pending Japan Patent Application No. 2013-553903 dated Jul. 2, 2014, 5 pages.

Patwardhan et al.; "Effect of voice quality on frequency-warped modeling of vowel spectra," *Speech Communication*, 2006; 48(8):1009-1023.

Ryan et al.; "Reflected Simplex Codebooks for Limited Feedback MIMO Beamforming," *Proc. IEEE ICC*, 2009.

Terriberry et al.; "A Multiply-Free Enumeration of Combinations With Replacement and Sign," *IEEE Signal Processing Letters*, 2008; vol. 15.

Virette et al.; "Enhanced Pulse Indexing CE for ACELP in USAC," *International Organization for Standardization, ISO/IEC JTC1/SC29/WG11, Coding of Moving Pictures and Audio*, Jan. 2011; MPEG2010/M19305, Daegu, Korea.

Wang et al.; "Frequency domain adaptive postfiltering for enhancement of noisy speech," *Speech Communication*, Mar. 1993; 12(1):41-56.

Waterschoot et al.; "Comparison of Linear Prediction Models for Audio Signals," *EURASIP Journal on Audio, Speech, and Music Processing*, Dec. 2008; Article ID 706935, 24 pages.

Bessette et al.; "Universal Speech/Audio Coding Using Hybrid ACELP/TCX Techniques," *IEEE International Conference on Acoustics, Speech, and Signal Processing*, Philadelphia, Pennsylvania, Mar. 18-23, 2005; 3:301-304.

Office Action and Search Report in co-pending Taiwan Patent Application No. 101104674 dated Apr. 3, 2014, 8 pages.

Office Action and Search Report in co-pending Taiwan Patent Application No. 101104682 dated May 7, 2014, 10 pages.

Office Action and Search Report in co-pending Taiwan Patent Application No. 101104678 dated Apr. 3, 2014, 8 pages.

Office Action and Search Report in co-pending Chinese Patent Application No. 2012800182653 dated Sep. 1, 2014, 7 pages.

Notification of Reasons for Rejection in co-pending Japan Patent Application No. 2013-553902 dated Oct. 7, 2014, 7 pages.

(56) References Cited

OTHER PUBLICATIONS

Office Action and Search Report in co-pending Chinese Patent Application No. 201280014994.1 dated Oct. 10, 2014, 14 pages.
Office Action and Search Report in co-pending Chinese Patent Application No. 201280015995.8 dated Nov. 2, 2014, 7 pages.
Office Action and Search Report in co-pending Chinese Patent Application No. 2012800159977 dated Sep. 19, 2014, 7 pages.
Office Action and Search Report in co-pending Chinese Patent Application No. 2012800164424 dated Sep. 28, 2014, 6 pages.
Office Action and Search Report in co-pending Chinese Patent Application No. 201280018224.4 dated Nov. 2, 2014, 8 pages.
Office Action and Search Report in co-pending Chinese Patent Application No. 2012800182827 dated Oct. 20, 2014, 23 pages.
Notice of Allowance in co-pending U.S. Appl. No. 13/966,666 dated Dec. 22, 2014, 35 pages.
Office Action and Search Report in co-pending Chinese Patent Application No. 2012800184818 dated Dec. 8, 2014, 9 pages.
Terriberry, Timothy B.; "Pulse Vector Coding," retrieved from the Internet Feb. 11, 2015; http://people.xiph.org/~tterribe/notes/cwrs.html.
Decision to Grant in co-pending Russian Patent Application No. 2013141935 dated Nov. 24, 2014, 7 pages.
Office Action and Search Report in co-pending Chinese Patent Application No. 2012800182511 dated Jan. 8, 2015, 8 pages.
Office Action in co-pending Korean Patent Application No. 10-2013-7024213 dated Mar. 12, 2015, 6 pages.

* cited by examiner

AUDIO CODEC SUPPORTING TIME-DOMAIN AND FREQUENCY-DOMAIN CODING MODES

CROSS-REFERENCE TO RELATED APPLICATIONS

This application is a continuation of copending International Application No. PCT/EP2012/052461, filed Feb. 14, 2012, which is incorporated herein by reference in its entirety, and additionally claims priority from U.S. Provisional Application No. 61/442,632, filed Feb. 14, 2011, which is also incorporated herein by reference in its entirety.

BACKGROUND OF THE INVENTION

The present invention is concerned with an audio codec supporting time-domain and frequency-domain coding modes.

Recently, the MPEG USAC codec has been finalized. USAC (Unified speech and audio coding) is a codec which codes audio signals using a mix of AAC (Advanced audio coding), TCX (Transform Coded Excitation) and ACELP (Algebraic Code-Excited Linear Prediction). In particular, MPEG USAC uses a frame length of 1024 samples and allows switching between AAC-like frames of 1024 or 8×128 samples, TCX 1024 frames or within one frame a combination of ACELP frames (256 samples), TCX 256 and TCX 512 frames.

Disadvantageously, the MPEG USAC codec is not suitable for applications necessitating low delay. Two-way communication applications, for example, necessitate such short delays. Owing to the USAC frame length of 1024 samples, USAC is not a candidate for these low delay applications.

In WO 2011147950, it has been proposed to render the USAC approach suitable for low-delay applications by restricting the coding modes of the USAC codec to TCX and ACELP modes, only. Further, it has been proposed to make the frame structure finer so as to obey the low-delay requirement imposed by low-delay applications.

However, there is still a need for providing an audio codec enabling low coding delay at an increased efficiency in terms of rate/distortion ratio. Advantageously, the codec should be able to efficiently handle audio signals of different types such as speech and music.

Thus, it is an objective of the present invention to provide an audio codec offering low-delay for low-delay applications, but at an increased coding efficiency in terms of, for example, rate/distortion ratio compared to USAC.

SUMMARY

According to an embodiment, an audio decoder may have: a time-domain decoder; a frequency-domain decoder; and an associator configured to associate each of consecutive frames of a data stream, each of which represents a corresponding one of consecutive portions of an audio signal, with one out of a mode dependent set of a plurality of frame coding modes, wherein the time-domain decoder is configured to decode frames having one of a first subset of one or more of the plurality of frame coding modes associated therewith, and the frequency-domain decoder is configured to decode frames having one of a second subset of one or more of the plurality of frame coding modes associated therewith, the first and second subsets being disjoint to each other, and wherein the associator is configured to perform the association dependent on a frame mode syntax element associated with the frames in the data stream, and operate in an active one of a plurality of operating modes with selecting the active operating mode out of the plurality of operating modes depending on the data stream and/or an external control signal, and changing the dependency of the performance of the association depending on the active operating mode.

According to another embodiment, an audio encoder may have: a time-domain encoder; a frequency-domain encoder; and an associator configured to associate each of consecutive portions of an audio signal with one out of a mode dependent set of a plurality of frame coding modes, wherein the time-domain encoder is configured to encode portions having one of a first subset of one or more of the plurality of frame coding modes associated wherewith, into a corresponding frame of a data stream, and wherein the frequency-domain encoder is configured to encode portions having one of a second subset of one or more of the plurality of encoding modes associated therewith, into a corresponding frame of the data stream, and wherein the associator is configured to operate in an active one of a plurality of operating modes such that, if the active operating mode is a first operating mode, the mode dependent set of the plurality of frame coding modes is disjoint to the first subset and overlaps with the second subset and if the active operating mode is a second operating mode, the mode dependent set of the plurality of encoding modes overlaps with the first and second subset.

According to another embodiment, an audio decoding method using a time-domain decoder, and a frequency-domain decoder, may have the steps of: associating each of consecutive frames of a data stream, each of which represents a corresponding one of consecutive portions of an audio signal, with one out of a mode dependent set of a plurality of frame coding modes; decoding frames having one of a first subset of one or more of the plurality of frame coding modes associated therewith, by the time-domain decoder; and decoding frames having one of a second subset of one or more of the plurality of frame coding modes associated therewith, by the frequency-domain decoder, the first and second subsets being disjoint to each other, wherein the association is dependent on a frame mode syntax element associated with the frames in the data stream, and wherein the association is performed in an active one of a plurality of operating modes with selecting the active operating mode out of the plurality of operating modes depending on the data stream and/or an external control signal, such that the dependency of the performance of the association changes depending on the active operating mode.

According to still another embodiment, an audio encoding method using a time-domain encoder and a frequency-domain encoder may have the steps of: associating each of consecutive portions of an audio signal with one out of a mode dependent set of a plurality of frame coding modes; encoding portions having one of a first subset of one or more of the plurality of frame coding modes associated wherewith, into a corresponding frame of a data stream by the time-domain encoder; and encoding portions having one of a second subset of one or more of the plurality of encoding modes associated therewith, into a corresponding frame of the data stream by the frequency-domain encoder, wherein the association is performed in an active one of a plurality of operating modes such that, if the active operating mode is a first operating mode, the mode dependent set of the plurality of frame coding modes is disjoint to the first subset and overlaps with the second subset and if the active operating mode is a second operating mode, the mode dependent set of the plurality of encoding modes overlaps with the first and second subset.

Another embodiment may have a computer program having a program code for performing, when running on a computer, an audio decoding method or an audio encoding method as mentioned above.

A basic idea underlying the present invention is that an audio codec supporting both, time-domain and frequency-domain coding modes, which has low-delay and an increased coding efficiency in terms of rate/distortion ratio, may be obtained if the audio encoder is configured to operate in different operating modes such that if the active operating mode is a first operating mode, a mode dependent set of available frame coding modes is disjoined to a first subset of time-domain coding modes, and overlaps with a second subset of frequency-domain coding modes, whereas if the active operating mode is a second operating mode, the mode dependent set of available frame coding modes overlaps with both subsets, i.e. the subset of time-domain coding modes as well as the subset of frequency-domain coding modes. For example, the decision as to which of the first and second operating mode is accessed, may be performed depending on an available transmission bitrate for transmitting the data stream. For example, the decision's dependency may be such that the second operating mode is accessed in case of lower available transmission bitrates, while the first operating mode is accessed in case of higher available transmission bitrates. In particular, by providing the encoder with the operating modes, it is possible to prevent the encoder from choosing any time-domain coding mode in case of the coding circumstances, such as determined by the available transmission bitrates, being such that choosing any time-domain coding mode would very likely yield coding efficiency loss when considering the coding efficiency in terms of rate/distortion ratio on a long-term basis. To be more precise, the inventors of the present application found out that suppressing the selection of any time-domain coding mode in case of (relative) high available transmission bandwidth results in a coding efficiency increase: while, on a short-term basis, one may assume that a time-domain coding mode may currently be of advantage compared to the frequency-domain coding modes, it is very likely that this assumption turns out to be incorrect if analyzing the audio signal for a longer period. Such longer analysis or look-ahead is, however, not possible in low-delay applications, and accordingly, preventing the encoder from accessing any time-domain coding mode beforehand enables the achievement of an increased coding efficiency.

In accordance with an embodiment of the present invention, the above idea is exploited to the extent that the data stream bitrate is further increased: While it is quite bitrate inexpensive to synchronously control the operating mode of encoder and decoder, or does not even cost any bitrate as the synchronicity is provided by some other means, the fact that encoder and decoder operate and switch between the operating modes synchronously may be exploited so as to reduce the signaling overhead for signaling the frame coding modes associated with the individual frames of the data stream in consecutive portions of the audio signal, respectively. In particular, while a decoder's associator may be configured to perform the association of each of the consecutive frames of the data stream with one of the mode-dependent sets of the plurality of frame-coding modes dependent on a frame mode syntax element associated with the frames of the data stream, the associator may particularly change the dependency of the performance of the association depending on the active operating mode. In particular, the dependency change may be such that if the active operating mode is the first operating mode, the mode-dependent set is disjoined to the first subset and overlaps with the second subset, and if the active operating mode is the second operating mode, the mode-dependent set overlaps with both subsets. However, less strict solutions increasing the bitrate are by exploiting knowledge on the circumstances associated with the currently pending operating mode are, however, also feasible.

BRIEF DESCRIPTION OF THE DRAWINGS

Embodiments of the present invention are described in more detail below with respect to the figures among which

DETAILED DESCRIPTION OF THE INVENTION

With regard to the description of the figures it is noted that descriptions of elements in one figure shall equally apply to elements having the same reference sign associated therewith in another figure, as not explicitly taught otherwise.

Figure 1:
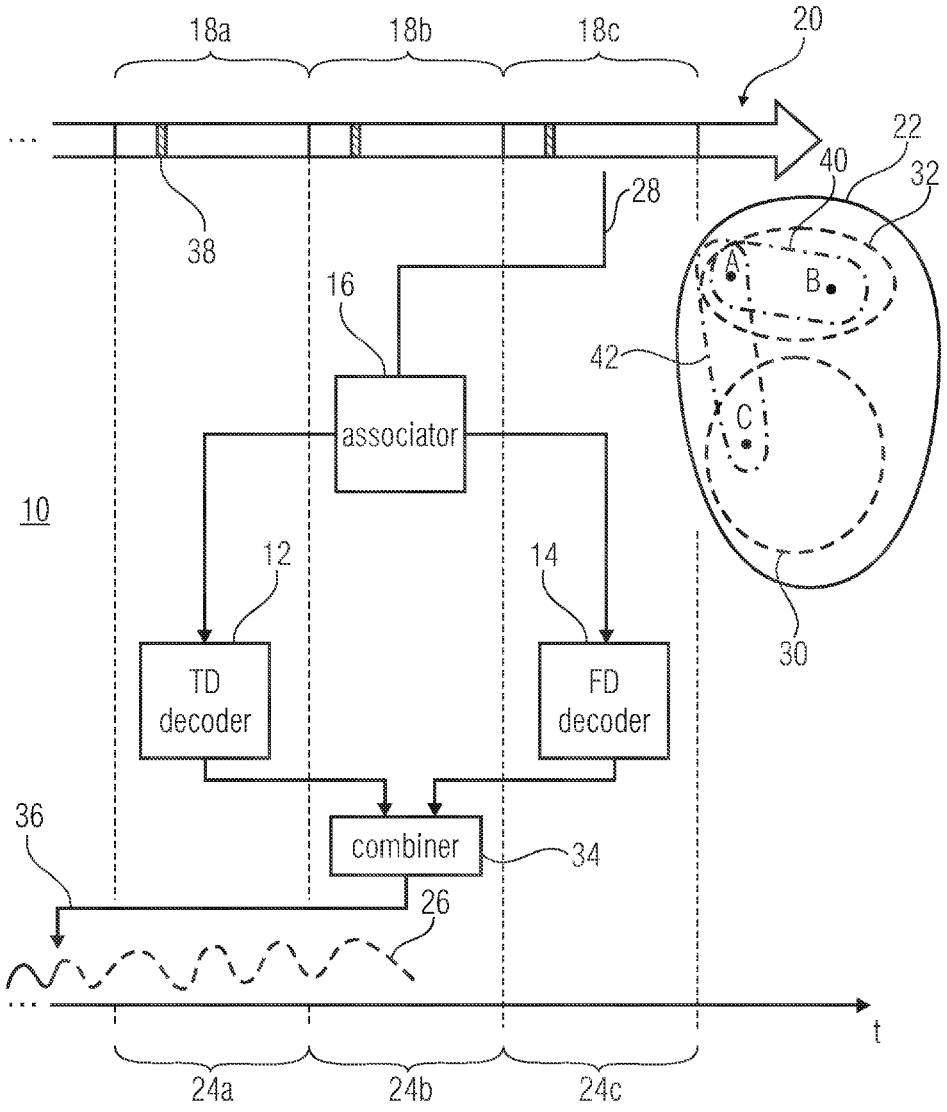
FIG. 1 shows a block diagram of an audio decoder according to an embodiment.

FIG. 1 shows an audio decoder 10 in accordance with an embodiment of the present invention. The audio decoder comprises a time-domain decoder 12 and a frequency-domain decoder 14. Further, the audio decoder 10 comprises an associator 16 configured to associate each of consecutive frames 18*a*-18*c* of a data stream 20 to one out of a mode-dependent set of a plurality 22 of frame coding modes which are exemplarily illustrated in FIG. 1 as A, B and C. There may be more than three frame coding modes, and the number may thus be changed from three to something else. Each frame 18*a-c* corresponds to one of consecutive portions 24*a-c* of an audio signal 26 which the audio decoder is to reconstruct from data stream 20.

To be more precise, the associator 16 is connected between an input 28 of decoder 10 on the one hand, and inputs of time-domain decoder 12 and frequency-domain decoder 14 on the other hand so as to provide same with associated frames 18*a-c* in a manner described in more detail below.

The time-domain decoder 12 is configured to decode frames having one of a first subset 30 of one or more of the plurality 22 of frame-coding modes associated therewith, and the frequency-domain decoder 14 is configured to decode frames having one of a second subset 32 of one or more of the plurality 22 of frame-coding modes associated therewith. The first and second subsets are disjoined to each other as illustrated in FIG. 1. To be more precise, the time-domain decoder 12 has an output so as to output reconstructed portions 24*a-c* of the audio signal 26 corresponding to frames having one of the first subsets 30 of the frame-coding modes associated therewith, and the frequency-domain decoder 14 comprises an output for outputting reconstructed portions of the audio signal 26 corresponding to frames having one of the second subset 32 of frame-coding modes associated therewith.

As is shown in FIG. 1, the audio decoder 10 may have, optionally, a combiner 34 which is connected between the outputs of time-domain decoder 12 and frequency-domain decoder 14 on the one hand and an output 36 of decoder 10 on the other hand. In particular, although FIG. 1 suggests that portions 24*a*-24*c* do not overlap each other, but immediately follow each other in time t, in which case combiner 34 could be missing, it is also possible that portions 24*a*-24*c* are, at least partially, consecutive in time t, but partially overlap each other such as, for example, in order to allow for time-aliasing cancellation involved with a lapped transform used by frequency-domain decoder 14, for example, as it is the case with the subsequently-explained more detailed embodiment of frequency-domain decoder 14.

Prior to further prosecuting with the description of the embodiment of FIG. 1, it should be noted that the number of frame-coding modes A-C illustrated in FIG. 1 is merely illustrative. The audio decoder of FIG. 1 may support more than three coding modes. In the following, frame-coding modes of subset 32 are called frequency-domain coding modes, whereas frame-coding modes of subset 30 are called time-domain coding modes. The associator 16 forwards frames 15*a-c* of any time-domain coding mode 30 to the time-domain decoder 12, and frames 18*a-c* of any frequency-domain coding mode to frequency-domain decoder 14. Combiner 34 correctly registers the reconstructed portions of the audio signal 26 as output by time-domain and frequency-domain decoders 12 and 14 so as to be arranged consecutively in time t as indicated in FIG. 1. Optionally, combiner 34 may perform an overlap-add functionality between frequency-domain coding mode portions 24, or other specific measures at the transitions between immediately consecutive portions, such as an overlap-add functionality, for performing aliasing cancellation between portions output by frequency-domain decoder 14. Forward aliasing cancellation may be performed between immediately following portions 24*a-c* output by time-domain and frequency-domain decoders 12 and 14 separately, i.e. for transitions from frequency-domain coding mode portions 24 to time-domain coding mode portions 24 and vice-versa. For further details regarding possible implementations, reference is made to the more detailed embodiments described further below.

As will be outlined in more detail below, the associator 16 is configured to perform the association of the consecutive frames 18*a-c* of the data stream 20 with the frame-coding modes A-C in a manner which avoids the usage of a time-domain coding mode in cases where the usage of such time-domain coding mode is inappropriate such as in cases of high available transmission bitrates where time-domain coding modes are likely to be inefficient in terms of rate/distortion ratio compared to frequency-domain coding modes so that the usage of the time-domain frame-coding mode for a certain frame 18*a*-18*c* would very likely lead to a decrease in coding efficiency.

Accordingly, the associator 16 is configured to perform the association of the frames to the frame coding modes dependent on a frame mode syntax element associated with the frames 18*a-c* in the data stream 20. For example, the syntax of the data stream 20 could be configured such that each frame 18*a-c* comprises such a frame mode syntax element 38 for determining the frame-coding mode, which the corresponding frame 18*a-c* belongs to.

Further, the associator 16 is configured to operate in an active one of a plurality of operating modes, or to select a current operating mode out of a plurality of operating modes. Associator 16 may perform this selection depending on the data stream or dependent on an external control signal. For example, as will be outlined in more detail below, the decoder 10 changes its operating mode synchronously to the operating mode change at the encoder and in order to implement the synchronicity, the encoder may signal the active operating mode and the change in the active one of the operating modes within the data stream 20. Alternatively, encoder and decoder 10 may be synchronously controlled by some external control signal such as control signals provided by lower transport layers such as EPS or RTP or the like. The control signal externally provided may, for example, be indicative of some available transmission bitrate.

In order to instantiate or realize the avoidance of inappropriate selections or an inappropriate usage of time-domain coding modes as outlined above, the associator 16 is configured to change the dependency of the performance of the association of the frames 18 to the coding modes depending on the active operating mode. In particular, if the active operating mode is a first operating mode, the mode dependent set of the plurality of frame coding modes is, for example, the one shown at 40, which is disjoint to the first subset 30 and overlaps the second subset 32, whereas if the active operating mode is a second operating mode, the mode dependent set is, for example, as shown at 42 in FIG. 1 and overlaps the first and second subsets 30 and 32.

That is, in accordance with the embodiment of FIG. 1, the audio decoder 10 is controllable via data stream 20 or an external control signal so as to change its active operating mode between a first one and a second one, thereby changing the operation mode dependent set of frame coding modes accordingly, namely between 40 and 42, so that in accordance with one operating mode, the mode dependent set 40 is disjoint to the set of time-domain coding modes, whereas in the other operating mode the mode dependent set 42 contains at least one time-domain coding mode as well as at least one frequency-domain coding mode.

Figure 2:
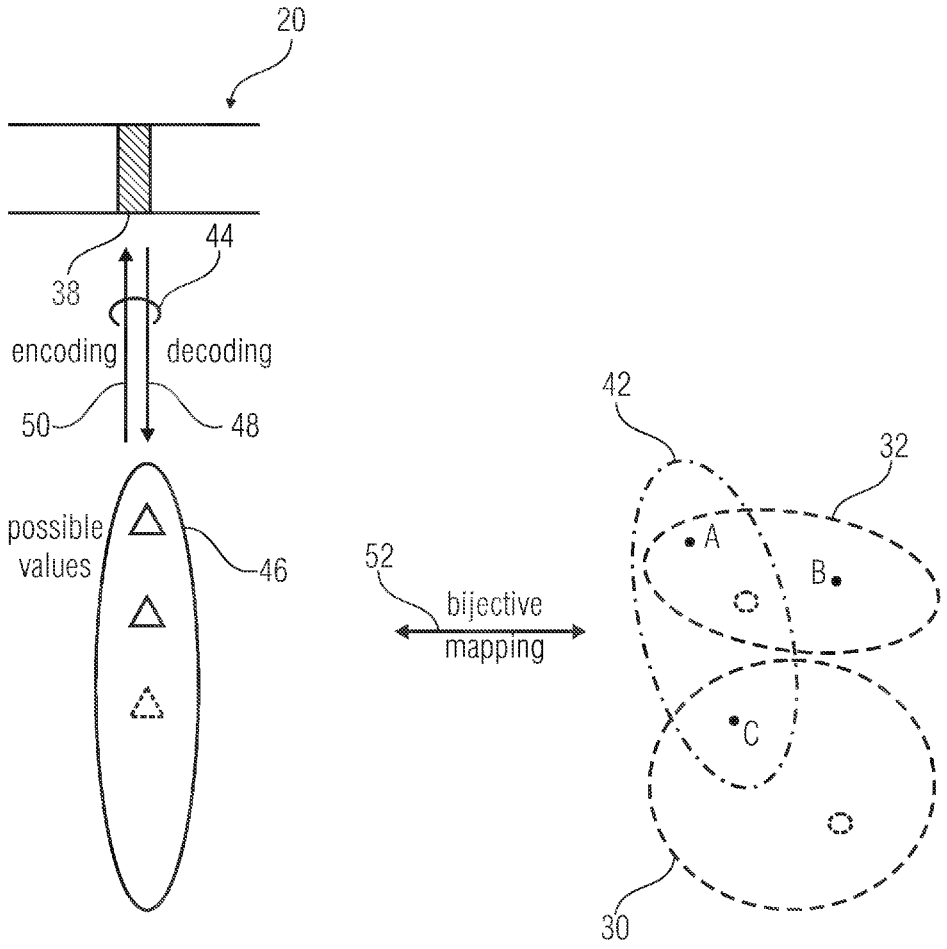
FIG. 2 shows a schematic of a bijective mapping between a the possible values of the frame mode syntax element and the frame coding modes of the mode dependent set in accordance with an embodiment.

In order to explain the change in the dependency of the performance of the association of the associator 16 in more detail, reference is made to FIG. 2, which exemplarily shows a fragment out of data stream 20, the fragment including a frame mode syntax element 38 associated with a certain one of frames 18*a* to 18*c* of FIG. 1. In this regard, it is briefly noted that the structure of the data stream 20 exemplified in FIG. 1 has been applied merely for illustrative purposes, and that a different structure may be applied as well. For example, although the frames 18*a* to 18*c* in FIG. 1 are shown as simply-connected or continuous portions of data stream 20 without any interleaving therebetween, such interleaving may be applied as well. Moreover, although FIG. 1 suggests that the frame mode syntax element 38 is contained within the frame it refers to, this is not necessarily the case. Rather, the frame mode syntax elements 38 may be positioned within data stream 20 outside frames 18*a* to 18*c*. Further, the number of frame mode syntax elements 38 contained within data stream 20 does not need to be equal to the number of frames 18*a* to 18*c* in data stream 20. Rather, the frame mode syntax element 38 of FIG. 2, for example, may be associated with more than one of frames 18*a* to 18*c* in data stream 20.

In any case, depending on the way the frame mode syntax element 38 has been inserted into data stream 20, there is a mapping 44 between the frame mode syntax element 38 as contained and transmitted via data stream 20, and a set 46 of possible values of the frame mode syntax element 38. For example, the frame mode syntax element 38 may be inserted into data stream 20 directly, i.e. using a binary representation such as, for example, PCM, or using a variable length code and/or using entropy coding, such as Huffman or arithmetic coding. Thus, the associator 16 may be configured to extract 48, such as by decoding, the frame mode syntax element 38 from data stream 20 so as to derive any of the set 46 of possible values wherein the possible values are representatively illustrated in FIG. 2 by small triangles. At the encoder side, the insertion 50 is done correspondingly, such as by encoding.

That is, each possible value which the frame mode syntax element 38 may possibly assume, i.e. each possible value within the possible value range 46 of frame mode syntax element 38, is associated with a certain one of the plurality of frame coding modes A, B and C. In particular, there is a bijective mapping between the possible values of set 46 on the one hand, and the mode dependent set of frame coding modes on the other hand. The mapping, illustrated by the double-headed arrow 52 in FIG. 2, changes depending on the active operating mode. The bijective mapping 52 is part of the functionality of the associator 16 which changes mapping 52 depending on the active operating mode. As explained with respect to FIG. 1, while the mode dependent set 40 or 42 overlaps with both frame coding mode subsets 30 and 32 in case of the second operating mode illustrated in FIG. 2, the mode dependent set is disjoint to, i.e. does not contain any elements of, subset 30 in case of the first operating mode. In other words, the bijective mapping 52 maps the domain of possible values of the frame mode syntax element 38 onto the co-domain of frame coding modes, called the mode dependent set 50 and 52, respectively. As illustrated in FIG. 1 and FIG. 2 by use of the solid lines of the triangles for the possible values of set 46, the domain of bijective mapping 52 may remain the same in both operating modes, i.e. the first and second operating mode, while the co-domain of bijective mapping 52 changes as is illustrated and described above.

However, even the number of possible values within set 46 may change. This is indicated by the triangle drawn with a dashed line in FIG. 2. To be more precise, the number of available frame coding modes may be different between the first and second operating mode. If so, however, the associator 16 is in any case still implemented such that the co-domain of bijective mapping 52 behaves as outlined above: there is no overlap between the mode dependent set and subset 30 in case of the first operating mode being active.

Stated differently, the following is noted. Internally, the value of the frame mode syntax element 38 may be represented by some binary value, the possible value range of which accommodates the set 46 of possible values independent from the currently active operating mode. To be even more precise, associator 16 internally represents the value of the frame syntax element 38 with a binary value of a binary representation. Using this binary values, the possible values of set 46 are sorted into an ordinal scale so that the possible values of set 46 remain comparable to each other even in case of a change of the operating mode. The first possible value of set 46 in accordance with this ordinal scale may for example, be defined to be the one associated with the highest probability among the possible values of set 46, with the second one of possible values of set 46 continuously being the one with the next lower probability and so forth. Accordingly, the possible values of frame mode syntax element 38 are thus comparable to each other despite a change of the operating mode. In the latter example, it may occur that domain and co-domain of bijective mapping 52, i.e. the set of possible values 46 and the mode dependent set of frame coding modes remains the same despite the active operating mode changing between the first and second operating modes, but the bijective mapping 52 changes the association between the frame coding modes of the mode dependent set on the one hand, and the comparable possible values of set 46 on the other hand. In the latter embodiment, the decoder 10 of FIG. 1 is still able to take advantage of an encoder which acts in accordance with the subsequently explained embodiments, namely by refraining from selecting the inappropriate time-domain coding modes in case of the first operating mode. By associating more probable possible values of set 46 solely with frequency-domain coding modes 32 in case of the first operating mode, while using the lower probable possible values of set 46 for the time-domain coding modes 30 only during the first operating mode, while changing this policy in case of the second operating mode results in a higher compression rate for data stream 20 if using entropy coding for insertion/extraction of frame mode syntax element 38 into/from data stream 20. In other words, while in the first operating mode, none of the time-domain coding modes 30 may be associated with a possible value of set 46 having associated therewith a probability higher than the probability for a possible value mapped by mapping 52 onto any of the frequency-domain coding modes 32, such a case exists in the second operating mode where at least one time-domain coding mode 30 is associated with such a possible value having associated therewith a higher probability than another possible value associated with, according to mapping 52, a frequency-domain coding mode 32.

The just mentioned probability associated with possible values 46 and optionally used for encoding/decoding same may be static or adaptively changed. Different sets of probability estimations may be used for different operating modes. In case of adaptively changing the probability, context-adaptive entropy coding may be used.

As illustrated in FIG. 1, one embodiment for the associator 16 is such that the dependency of the performance of the association depends on the active operating mode, and the frame mode syntax element 38 is coded into and decoded from the data stream 20 such that a number of the differentiable possible values within set 46 is independent from the active operating mode being the first or the second operating mode. In particular, in the case of FIG. 1 the number of differentiable possible values is two, as also illustrated in FIG. 2 when considering the triangles with the solid lines. In that case, for example, the associator 16 may be configured such that if the active operating mode is the first operating mode, the mode dependent set 40 comprises a first and a second frame coding mode A and B of the second subset 32 of frame coding modes, and the frequency-domain decoder 14, which is responsible for these frame coding modes, is configured to use different time-frequency resolutions in decoding the frames having one of the first and second frame coding modes A and B associated therewith. By this measure, one bit, for example, would be sufficient to transmit the frame mode syntax element 38 within data stream 20 directly, i.e. without any further entropy coding, wherein merely the bijective mapping 52 changes upon a change from the first operating mode to the second operating mode and vice versa.

As will be outlined in more detail below with respect to FIGS. 3 and 4, the time-domain decoder 12 may be a code-excited linear-prediction decoder, and the frequency-domain decoder may be a transform decoder configured to decode the frames having any of the second subset of frame coding modes associated therewith, based on transform coefficient levels encoded into data stream 20.

Figure 3:
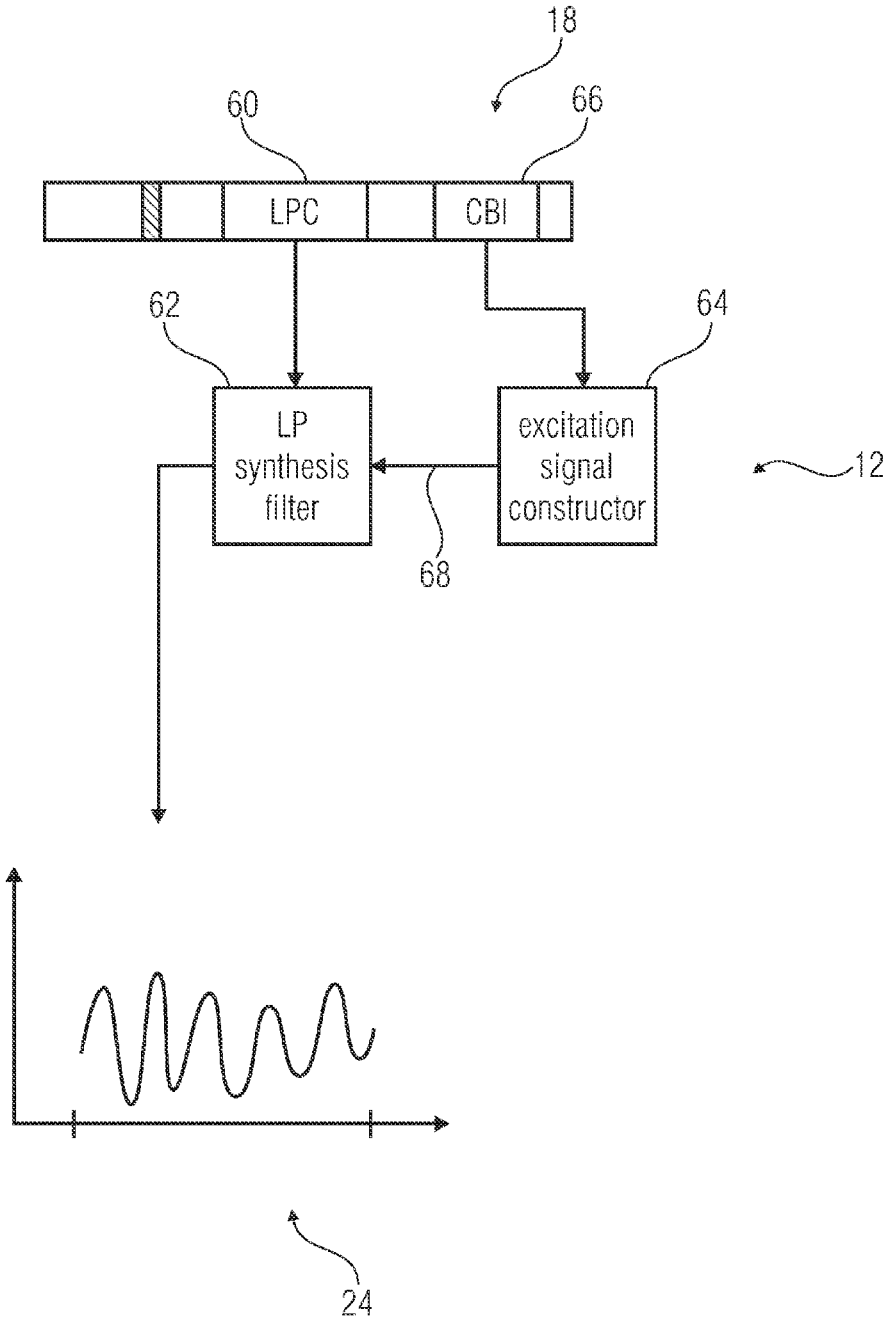
FIG. 3 shows a block diagram of a time-domain decoder according to an embodiment.

For example, see FIG. 3. FIG. 3 shows an example for the time-domain decoder 12 and a frame associated with a time-domain coding mode so that same passes time-domain decoder 12 to yield a corresponding portion 24 of the reconstructed audio signal 26. In accordance with the embodiment of FIG. 3—and in accordance with the embodiment of FIG. 4 to be described later—the time-domain decoder 12 as well as the frequency-domain decoder are linear prediction based decoders configured to obtain linear prediction filter coefficients for each frame from the data stream 12. Although FIGS. 3 and 4 suggest that each frame 18 may have linear prediction filter coefficients 16 incorporated therein, this is not necessarily the case. The LPC transmission rate at which the linear prediction coefficients 60 are transmitted within the data stream 12 may be equal to the frame rate of frames 18 or may differ therefrom. Nevertheless, encoder and decoder may synchronously operate with, or apply, linear prediction filter coefficients individually associated with each frame by interpolating from the LPC transmission rate onto the LPC application rate.

As shown in FIG. 3, the time-domain decoder 12 may comprise a linear prediction synthesis filter 62 and an excitation signal constructor 64. As shown in FIG. 3, the linear prediction synthesis filter 62 is fed with the linear prediction filter coefficients obtained from data stream 12 for the current time-domain coding mode frame 18. The excitation signal constructor 64 is fed with a excitation parameter or code such as a codebook index 66 obtained from data stream 12 for the currently decoded frame 18 (having a time-domain coding mode associated therewith). Excitation signal constructor 64 and linear prediction synthesis filter 62 are connected in series so as to output the reconstructed corresponding audio signal portion 24 at the output of synthesis filter 62. In particular, the excitation signal constructor 64 is configured to construct an excitation signal 68 using the excitation parameter 66 which may be, as indicated in FIG. 3, contained within the currently decoded frame having any time-domain coding mode associated therewith. The excitation signal 68 is a kind of residual signal, the spectral envelope of which is formed by the linear prediction synthesis filter 62. In particular, the linear prediction synthesis filter is controlled by the linear prediction filter coefficients conveyed within data stream 20 for the currently decoded frame (having any time-domain coding mode associated therewith), so as to yield the reconstructed portion 24 of the audio signal 26.

For further details regarding a possible implementation of the CELP decoder of FIG. 3, reference is made to known codecs such as the above mentioned USAC [2] or the AMR-WB+ codec [1], for example. According to latter codecs, the CELP decoder of FIG. 3 may be implemented as an ACELP decoder according to which the excitation signal 68 is formed by combining a code/parameter controlled signal, i.e. innovation excitation, and a continuously updated adaptive excitation resulting from modifying a finally obtained and applied excitation signal for an immediately preceding time-domain coding mode frame in accordance with a adaptive excitation parameter also conveyed within the data stream 12 for the currently decoded time-domain coding mode frame 18. The adaptive excitation parameter may, for example, define pitch lag and gain, prescribing how to modify the past excitation in the sense of pitch and gain so as to obtain the adaptive excitation for the current frame. The innovation excitation may be derived from a code 66 within the current frame, with the code defining a number of pulses and their positions within the excitation signal. Code 66 may be used for a codebook look-up, or otherwise—logically or arithmetically—define the pulses of the innovation excitation—in terms of number and location, for example.

Figure 4:
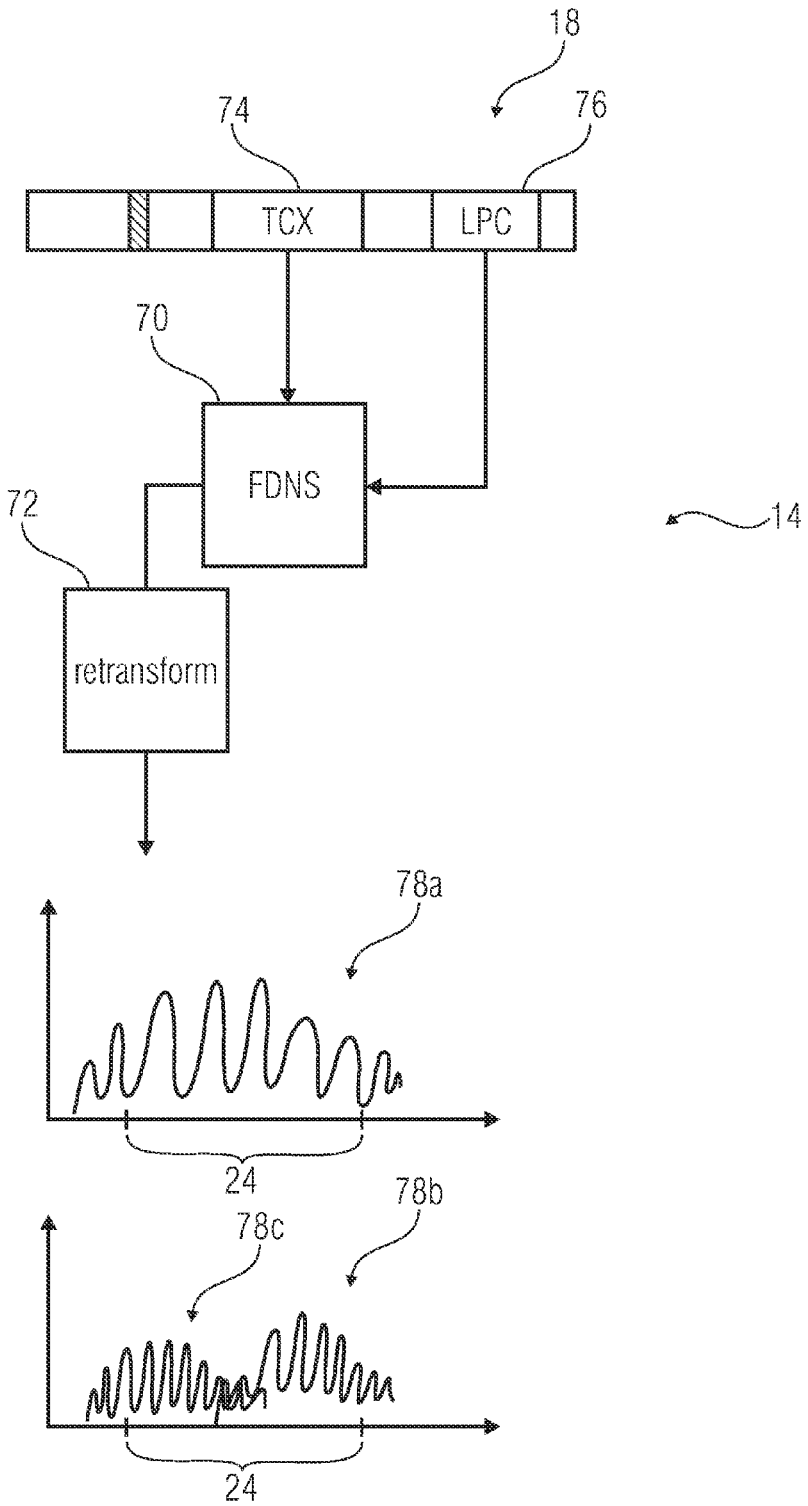
FIG. 4 shows a block diagram of a frequency-domain encoder according to an embodiment.

Similarly, FIG. 4 shows a possible embodiment for the frequency-domain decoder 14. FIG. 4 shows a current frame 18 entering frequency-domain decoder 14, with frame 18 having any frequency-domain coding mode associated therewith. The frequency-domain decoder 14 comprises a frequency-domain noise shaper 70, the output of which is connected to a retransformer 72. The output of the re-transformer 72 is, in turn, the output of frequency-domain decoder 14, outputting a reconstructed portion of the audio signal corresponding to frame 18 having currently been decoded.

As shown in FIG. 4, data stream 20 may convey transform coefficient levels 74 and linear prediction filter coefficients 76 for frames having any frequency-domain coding mode associated therewith. While the linear prediction filter coefficients 76 may have the same structure as the linear prediction filter coefficients associated with frames having any time-domain coding mode associated therewith, the transform coefficient levels 74 are for representing the excitation signal for frequency-domain frames 18 in the transform domain. As known from USAC, for example, the transform coefficient levels 74 may be coded differentially along the spectral axis. The quantization accuracy of the transform coefficient levels 74 may be controlled by a common scale factor or gain factor. The scale factor may be part of the data stream and assumed to be part of the transform coefficient levels 74. However, any other quantization scheme may be used as well. The transform coefficient levels 74 are fed to frequency-domain noise shaper 70. The same applies to the linear prediction filter coefficients 76 for the currently decoded frequency-domain frame 18. The frequency-domain noise shaper 70 is then configured to obtain an excitation spectrum of an excitation signal from the transform coefficient levels 74 and to shape this excitation spectrum spectrally in accordance with the linear prediction filter coefficients 76. To be more precise, the frequency-domain noise shaper 70 is configured to dequantize the transform coefficient levels 74 in order to yield the excitation signal's spectrum. Then, the frequency-domain noise shaper 70 converts the linear prediction filter coefficients 76 into a weighting spectrum so as to correspond to a transfer function of a linear prediction synthesis filter defined by the linear prediction filter coefficients 76. This conversion may involve an ODFT applied to the LPCs so as to turn the LPCs into spectral weighting values. Further details may be obtained from the USAC standard. Using the weighting spectrum the frequency-domain noise shaper 70 shapes—or weights—the excitation spectrum obtained by the transform coefficient levels 74, thereby obtaining the excitation signal spectrum. By the shaping/weighting, the quantization noise introduced at the encoding side by quantizing the transform coefficients is shaped so as to be perceptually less significant. The retransformer 72 then retransforms the shaped excitation spectrum as output by frequency domain noise shaper 70 so as to obtain the reconstructed portion corresponding to the just decoded frame 18.

As already mentioned above, the frequency-domain decoder 14 of FIG. 4 may support different coding modes. In particular, the frequency-domain decoder 14 may be configured to apply different time-frequency resolutions in decoding frequency-domain frames having different frequency-domain coding modes associated therewith. For example, the retransform performed by retransformer 72 may be a lapped transform, according to which consecutive and mutually overlapping windowed portions of the signal to be transformed are subdivided into individual transforms, wherein retransforming 72 yields a reconstruction of these windowed portions 78*a*, 78*b* and 78*c*. The combiner 34 may, as already noted above, mutually compensate aliasing occurring at the overlap of these windowed portions by, for example, an overlap-add process. The lapped transform or lapped retransform of retransformer 72 may be, for example, a critically sampled transform/retransform which necessitates time aliasing cancellation. For example, retransformer 72 may perform an inverse MDCT. In any case, the frequency-domain coding modes A and B may, for example, differ from each other in that the portion 18 corresponding to the currently decoded frame 18 is either covered by one windowed portion 78—also extending into the preceding and succeeding portions—thereby yielding one greater set of transform coefficient levels 74 within frame 18, or into two consecutive windowed sub-portions 78*c* and 78*b*—being mutually overlapping and extending into, and overlapping with, the preceding portion and succeeding portion, respectively—thereby yielding two smaller sets of transform coefficient levels 74 within frame 18. Accordingly, while decoder and frequency-domain noise shaper 70 and retransformer 72 may, for example, perform two operations—shaping and retransforming—for frames of mode A, they manually perform one operation per frame of frame coding mode B for example.

The embodiments for an audio decoder described above were especially designed to take advantage of an audio encoder which operates in different operating modes, namely so as to change the selection among frame coding modes between these operating modes to the extent that time-domain frame coding modes are not selected in one of these operating modes, but merely in the other. It should be noted, however, that the embodiments for an audio encoder described below would also—at least as far as a subset of these embodiments is concerned—fit to an audio decoder which does not support different operating modes. This is at least true for those encoder embodiments according to which the data stream generation does not change between these operation modes. In other words, in accordance with some of the embodiments for an audio encoder described below, the restriction of the selection of frame coding modes to frequency-domain coding modes in one of the operating modes does not reflect itself within the data stream 12 where the operating mode changes are, insofar, transparent (except for the absence of time-domain frame coding modes during one of these operating modes being active). However, the especially dedicated audio decoders according to the various embodiments outlined above form, along with respective embodiments for an audio encoder outlined above, audio codecs which take additional advantage of the frame coding mode selection restriction during a special operating mode corresponding, as outlined above, to special transmission conditions, for example.

Figure 5:
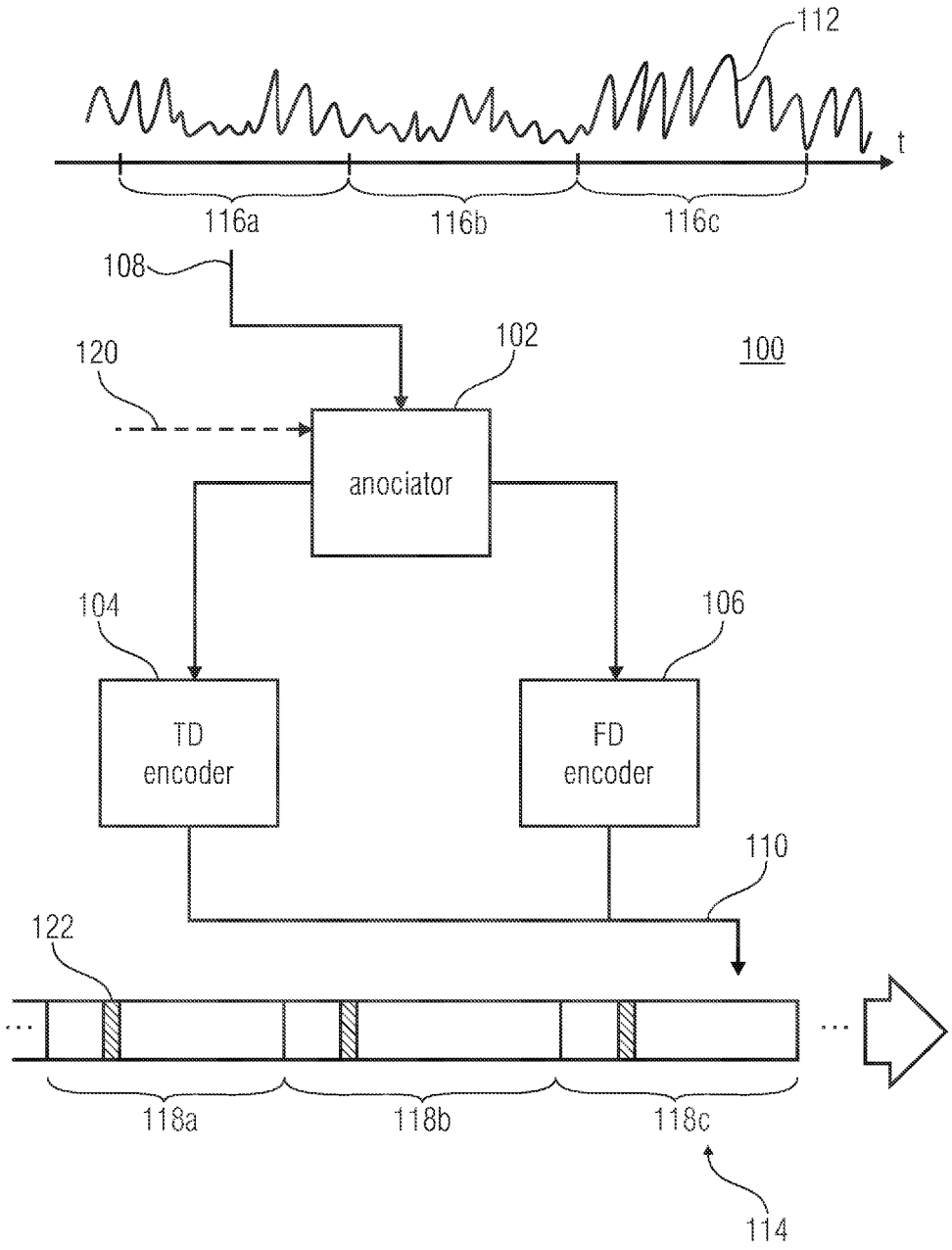
FIG. 5 shows a block diagram of an audio encoder according to an embodiment.

FIG. 5 shows an audio encoder according to an embodiment of the present invention. The audio encoder of FIG. 5 is generally indicated at 100 and comprises an associator 102, a time-domain encoder 104 and a frequency-domain encoder 106, with associator 102 being connected between an input 108 of audio encoder 100 on the one hand and inputs of time-domain encoder 104 and frequency-domain encoder 106 on the other hand. The outputs of time-domain encoder 104 and frequency-domain encoder 106 are connected to an output 110 of audio encoder 100. Accordingly, the audio signal to be encoded, indicated at 112 in FIG. 5, enters input 108 and the audio encoder 100 is configured to form a data stream 114 therefrom.

The associator 102 is configured to associate each of consecutive portions 116*a* to 116*c* which correspond to the aforementioned portions 24 of the audio signal 112, with one out of a mode dependent set of a plurality of frame coding modes (see 40 and 42 of FIGS. 1 to 4).

The time-domain encoder 104 is configured to encode portions 116*a* to 116*c* having one of a first subset 30 of one or more of the plurality 22 of frame coding modes associated therewith, into a corresponding frame 118*a* to 118*c* of the data stream 114. The frequency-domain encoder 106 is likewise responsible for encoding portions having any frequency-domain coding mode of set 32 associated therewith into a corresponding frame 118*a* to 118*c* of data stream 114.

The associator 102 is configured to operate in an active one of a plurality of operating modes. To be more precise, the associator 102 is configured such that exactly one of the plurality of operating modes is active, but the selection of the active one of the plurality of operating modes may change during sequentially encoding portions 116*a* to 116*c* of audio signal 112.

In particular, the associator 102 is configured such that if the active operating mode is a first operating mode, the mode dependent set behaves like set 40 of FIG. 1, namely same is disjoint to the first subset 30 and overlaps with the second subset 32, but if the active operating mode is a second operating mode, the mode dependent set of the plurality of encoding modes behaves like mode 42 of FIG. 1, i.e. same overlaps with the first and second subsets 30 and 32.

As outlined above, the functionality of the audio encoder of FIG. 5 enables to externally control the encoder 100 such that same is prevented from disadvantageously selecting any time-domain frame coding mode although the external conditions, such as the transmission conditions, are such that preliminarily selecting any time-domain frame coding frame would very likely yield a lower coding efficiency in terms of rate/distortion ratio when compared to restricting the selection to frequency-domain frame coding modes only. As shown in FIG. 5, associator 102 may, for example, be configured to receive an external control signal 120. Associator 102 may, for example, be connected to some external entity such that the external control signal 120 provided by the external entity is indicative of an available transmission bandwidth for a transmission of data stream 114. This external entity may, for example, be part of an underlying lower transmission layer such as lower in terms of the OSI layer model. For example, the external entity may be part of an LTE communication network. Signal 122 may, naturally, be provided based on an estimate of an actual available transmission bandwidth or an estimate of a mean future available transmission bandwidth. As already noted above with respect to FIGS. 1 to 4, the "first operating mode" may be associated with available transmission bandwidths being lower than a certain threshold, whereas the "second operating mode" may be associated with available transmission bandwidths exceeding the predetermined threshold, thereby preventing the encoder 100 from choosing any time-domain frame coding mode in inappropriate conditions where the time-domain coding is very likely to yield more inefficient compression, namely if the available transmission bandwidths is lower than a certain threshold.

It should be noted, however, that the control signal 120 may also be provided by some other entity such as, for example, a speech detector which analyzes the audio signal to be reconstructed, i.e. 112, so as to distinguish between speech phases, i.e. time intervals, during which a speech component within the audio signal 112 is predominant, and non-speech phases, where other audio sources such as music or the like are predominant within audio signal 112. The control signal 120 may be indicative of this change in speech and non-speech phases and the associator 102 may be configured to change between the operating modes accordingly. For example, in speech phases the associator 102 could enter the aforementioned "second operating mode" while the "first operating mode" could be associated with non-speech phases, thereby obeying the fact that choosing time-domain frame coding modes during non-speech phases very likely results in a less-efficient compression.

While the associator 102 may be configured to encode a frame mode syntax element 122 (compare syntax element 38 in FIG. 1) into the data stream 114 so as to indicate for each portion 116*a* to 116*c* which frame coding mode of the plurality of frame coding modes the respective portion is associated with, the insertion of this frame mode syntax element 122 into a data stream 114 may not depend on the operating mode so as to yield the data stream 20 with the frame mode syntax elements 38 of FIGS. 1 to 4. As already noted above, the data stream generation of data stream 114 may be performed independent from the operating mode currently active.

However, in terms of bitrate overhead, it may be of advantage if the data stream 114 is generated by the audio encoder 100 of FIG. 5 so as to yield the data stream 20 discussed above with respect to the embodiments of FIGS. 1 to 4, according to which the data stream generation is advantageously adapted to the currently active operating mode.

Accordingly, in accordance with an embodiment of the audio encoder 100 of FIG. 5 fitting to the embodiments described above for the audio decoder with respect to FIGS. 1 to 4, the associator 102 may be configured to encode the frame mode syntax element 122 into the data stream 114 using the bijective mapping 52 between the set of possible values 46 of the frame mode syntax element 122 associated with a respective portion 116*a* to 116*c* on the one hand, and the mode dependent set of the frame coding modes on the other hand, which bijective mapping 52 changes depending on the active operating mode. In particular, the change may be such that if the active operating mode is a first operating mode, the mode dependent set behaves like set 40, i.e. same is disjoint to the first subset 30 and overlaps with the second subset 32, whereas if the active operating mode is the second operating mode the mode dependent set is like set 42, i.e. it overlaps with both the first and second subsets 30 and 32. In particular, as already noted above, the number of possible values in the set 46 may be two, irrespective of the active operating mode being the first or second operating mode, and the associator 102 may be configured such that if the active operating mode is the first operating mode, the mode dependent set comprises frequency-domain frame coding modes A and B, and the frequency-domain encoder 106 may be configured to use different time-frequency resolutions in encoding respective portions 116*a* to 116*c* depending on their frame coding being mode A or mode B.

Figure 6:
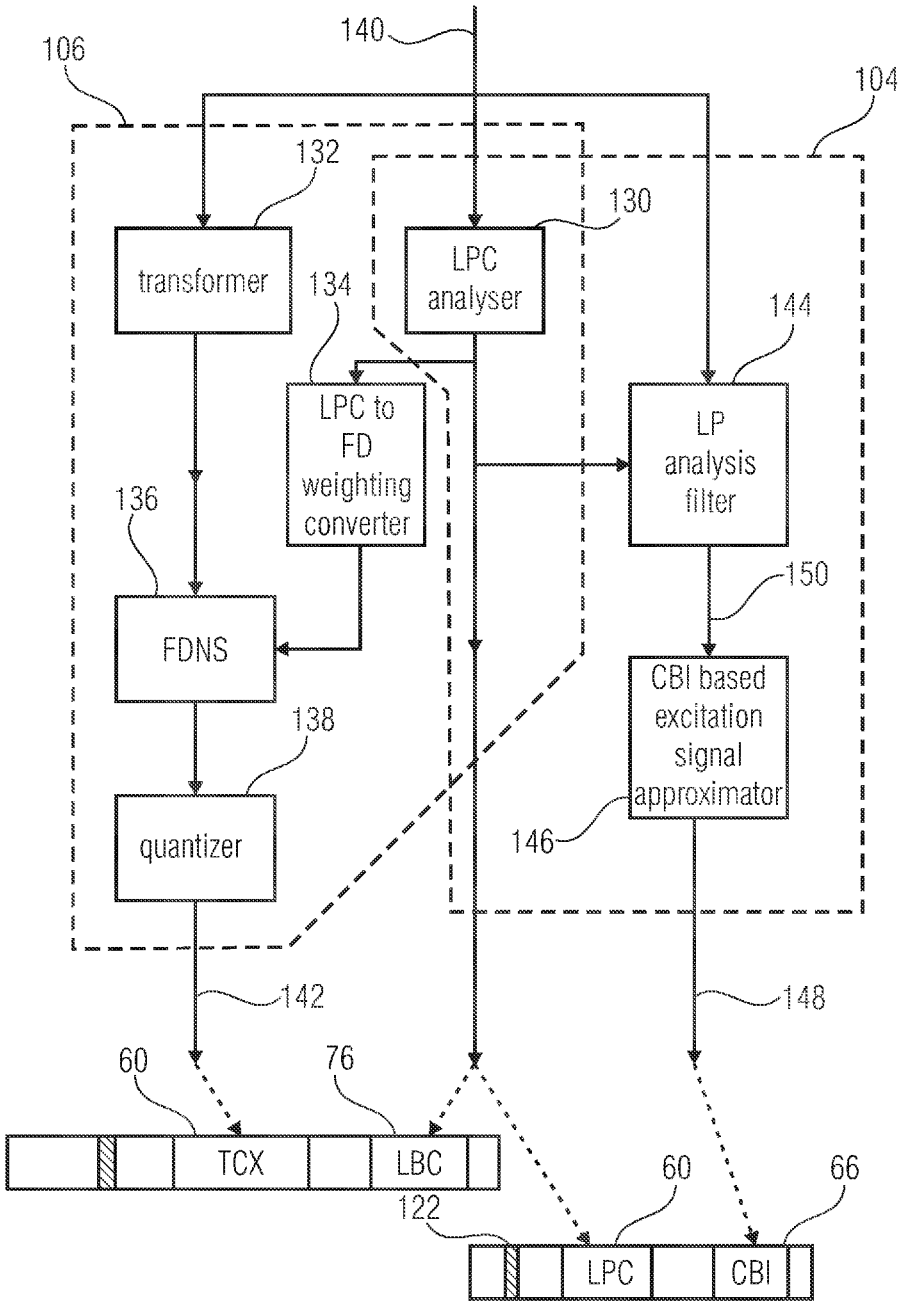
FIG. 6 shows an embodiment for time-domain and frequency-domain encoders according to an embodiment.

FIG. 6 shows an embodiment for a possible implementation of the time-domain encoder 104 and a frequency-domain encoder 106 corresponding to the fact already noted above, according to which code-excited linear-prediction coding may be used for the time-domain frame coding mode, while transform coded excitation linear prediction coding is used for the frequency-domain coding modes. Accordingly, according to FIG. 6 the time-domain encoder 104 is a code-excited linear-prediction encoder and the frequency-domain encoder 106 is a transform encoder configured to encode the portions having any frequency-domain frame coding mode associated therewith using transform coefficient levels, and encode same into the corresponding frames 118*a* to 118*c* of the data stream 114.

In order to explain a possible implementation for time-domain encoder 104 and frequency-domain encoder 106, reference is made to FIG. 6. According to FIG. 6, frequency-domain encoder 106 and time-encoder 104 co-own or share an LPC analyzer 130. It should be noted, however, that this circumstance is not critical for the present embodiment and that a different implementation may also be used according to which both encoders 104 and 106 are completely separated from each other. Moreover, with regard to the encoder embodiments as well as the decoder embodiments described above with respect to FIGS. 1 and 4, it is noted that the present invention is not restricted to cases where both coding modes, i.e. frequency-domain frame coding modes as well as time-domain frame coding modes, are linear prediction based. Rather, encoder and decoder embodiments are also transferable to other cases where either one of the time-domain coding and frequency-domain coding is implemented in a different manner.

Coming back to the description of FIG. 6, the frequency-domain encoder 106 of FIG. 6 comprises, besides LPC analyzer 130, a transformer 132, an LPC-to-frequency domain weighting converter 134, a frequency-domain noise shaper 136 and a quantizer 138. Transformer 132, frequency domain noise shaper 136 and quantizer 138 are serially connected between a common input 140 and an output 142 of frequency-domain encoder 106. The LPC converter 134 is connected between an output of LPC analyzer 130 and a weighting input of frequency domain noise shaper 136. An input of LPC analyzer 130 is connected to common input 140.

As far as the time-domain encoder 104 is concerned, same comprises, besides the LPC analyzer 130, an LP analysis filter 144 and a code based excitation signal approximator 146 both being serially connected between common input 140 and an output 148 of time-domain encoder 104. A linear prediction coefficient input of LP analysis filter 144 is connected to the output of LPC analyzer 130.

In encoding the audio signal 112 entering at input 140, the LPC analyzer 130 continuously determines linear prediction coefficients for each portion 116*a* to 116*c* of the audio signal 112. The LPC determination may involve autocorrelation determination of consecutive—overlapping or non-overlapping—windowed portions of the audio signal—with performing LPC estimation onto the resulting autocorrelations (optionally with previously subjecting the autocorrelations to Lag windowing) such as using a (Wiener-)Levison-Durbin algorithm or Schur algorithm or other.

As described with respect to FIGS. 3 and 4, LPC analyzer 130 does not necessarily signal the linear predication coefficients within data stream 114 at an LPC transmission rate equal to the frame rate of frames 118*a* to 118*c*. A rate even higher than that rate may also be used. generally, LPC analyzer 130 may determine the LPC information 60 and 76 at an LPC determination rate defined by the above mentioned rate of autocorrelations, for example, based on which the LPCs are determined. Then, LPC analyzer 130 may insert the LPC information 60 and 76 into the data stream at an LPC transmission rate which may be lower than the LPC determination rate. and TD and FD encoders 104 and 106, in turn, may apply the linear prediction coefficients with updating same at an LPC application rate which is higher than the LPC transmission rate, by interpolating the transmitted LPC information 60 and 76 within frames 118*a* to 118*c* of data stream 114. In particular, as the FD encoder 106 and the FD decoder, apply the LPC coefficients once per transform, the LPC application rate within FD frames may be lower than the rate at which the LPC coefficients applied in the TD encoder/decoder are adapted/updated by interpolating from the LPC transmission rate. As the interpolation may also be performed, synchronously, at the decoding side, the same linear prediction coefficients are available for time-domain and frequency-domain encoders on the one hand and time-domain and frequency-domain decoders on the other hand. In any case, LPC analyzer 130 determines linear-prediction coefficients for the audio signal 112 at some LPC determination rate equal to or higher than the frame rate and inserts same into the data stream at a LPC transmission rate which may be equal to the LPC determination rate or lower than that. The LP analysis filter 144 may, however, interpolate so as to update the LPC analysis filter at an LPC application rate higher than the LPC transmission rate. LPC converter 134 may or may not perform interpolation so as to determine LPC coefficients for each transform or each LPC to spectral weighting conversion necessitated. In order to transmit the LPC coefficients, same may be subject to quantization in an appropriate domain such as in the LSF/LSP domain.

The time-domain encoder 104 may operate as follows. The LP analysis filter may filter time-domain coding mode portions of the audio signal 112 depending on the linear prediction coefficient output by LPC analyzer 130. At the output of LP analysis filter 144, an excitation signal 150 is thus derived. The excitation signal is approximated by approximator 146. In particular, approximator 146 sets a code such as codebook indices or other parameters to approximate the excitation signal 150 such as by minimizing or maximizing some optimization measure defined, for example, by a deviation of excitation signal 150 on the one hand and the synthetically generated excitation signal as defined by the codebook index on the other hand in the synthesized domain, i.e. after applying the respective synthesis filter according to the LPCs onto the respective excitation signals. The optimization measure may optionally be perceptually emphasized deviations at perceptually more relevant frequency bands. The innovation excitation determined by the code set by the approximator 146, may be called innovation parameter.

Thus, approximator 146 may output one or more innovation parameters per time-domain frame coding mode portion so as to be inserted into corresponding frames having a time-domain coding mode associated therewith via, for example, frame mode syntax element 122. The frequency-domain encoder 106, in turn, may operate as follows. The transformer 132 transforms frequency-domain portions of the audio signal 112 using, for example, a lapped transform so as to obtain one or more spectra per portion. The resulting spectrogram at the output of transformer 132 enters the frequency domain noise shaper 136 which shapes the sequence of spectra representing the spectrogram in accordance with the LPCs. To this end, the LPC converter 134 converts the linear prediction coefficients of LPC analyzer 130 into frequency-domain weighting values so as to spectrally weight the spectra. This time, the spectral weight is performed such that an LP analysis filter's transfer function results. That is, an ODFT may be, for example, used so as to convert the LPC coefficients into spectral weights which may then be used to divide the spectra output be transformer 132, whereas multiplication is used at the decoder side.

Thereinafter, quantizer 138 quantizes the resulting excitation spectrum output by frequency-domain noise shaper 136 into transform coefficient levels 60 for insertion into the corresponding frames of data stream 114.

In accordance with the embodiments described above, an embodiment of the present invention may be derived when modifying the USAC codec discussed in the introductory portion of the specification of the present application by modifying the USAC encoder to operate in different operating modes so as to refrain from choosing the ACELP mode in case of a certain one of the operating modes. In order to enable the achievement of a lower delay, the USAC codec may be further modified in the following way: for example, independent from the operating mode, only TCX and ACELP frame coding modes may be used. To achieve lower delay, the frame length may be reduced in order to reach the framing of 20 milliseconds. In particular, in rendering a USAC codec more efficient in accordance with the above embodiments, the operation modes of USAC, namely narrowband (NB), wideband (WB) and super-wideband (SWB), may be amended such that merely a proper subset of the overall available frame coding modes are available within the individual operation modes in accordance with the subsequently explained table:

| Mode | Input sampling rate [kHz] | Frame length [ms] | ACELP/TCX modes used |
|---|---|---|---|
| NB | 8 kHz | 20 | ACELP or TCX |
| WB | 16 kHz | 20 | ACELP or TCX |
| SWB low rates (12-32 kbps) | 32 kHz | 20 | ACELP or TCX |
| SWB high rates (48-64 kbps) | 32 kHz | 20 | TCX or 2xTCX |
| SWB very high rates (96-128 kbps) | 32 kHz | 20 | TCX or 2xTCX |
| FB | 48 kHz | 20 | TCX or 2x-TCX |

As the above table makes clear, in the embodiments described above, the decoder's operation mode may not only be determined from an external signal or the data stream exclusively, but based on a combination of both. For example, in the above table, the data stream may indicate to the decoder a main mode, i.e. NB, WB, SWB, FB, by way of a coarse operation mode syntax element which is present in the data stream in some rate which may be lower than the frame rate. The encoder inserts this syntax element in addition to syntax elements 38. The exact operation mode, however, may necessitate the inspection of an additional external signal indicative of the available bitrate. In case of SWB, for example, the exact mode depends on the available bitrate lying below 48 kbps, being equal to or greater than 48 kbps, and being lower than 96 kbps, or being equal to or greater than 96 kbps.

Regarding the above embodiments it should be noted that, although in accordance with alternative embodiments, it is of advantage if the set of all plurality of frame coding modes with which the frames/time portions of the information signal are associatable, exclusively consists of time-domain or frequency-domain frame coding modes, this may be different, so that there may also be one or more than one frame coding mode which is neither time-domain nor frequency-domain coding mode.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

Depending on certain implementation requirements, embodiments of the invention can be implemented in hardware or in software. The implementation can be performed using a digital storage medium, for example a floppy disk, a DVD, a Blu-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

LITERATURE

[1]: 3GPP, "Audio codec processing functions; Extended Adaptive Multi-Rate-Wideband (AMR-WB+) codec; Transcoding functions", 2009, 3GPP TS 26.290.

[2]: USAC codec (Unified Speech and Audio Codec), ISO/IEC CD 23003-3 dated Sep. 24, 2010.

The invention claimed is:

1. An audio decoder comprising:

a time-domain decoder;

a frequency-domain decoder; and an associator configured to associate each of consecutive frames of a data stream, each of which represents a corresponding one of consecutive portions of an audio signal, with one out of a mode dependent set of a plurality of frame coding modes, wherein the time-domain decoder is configured to decode frames comprising one of a first subset of one or more of the plurality of frame coding modes associated therewith, and the frequency-domain decoder is configured to decode frames comprising one of a second subset of one or more of the plurality of frame coding modes associated therewith, the first and second subsets being disjoint to each other, wherein the associator is configured to perform the association dependent on a frame mode syntax element associated with the frames in the data stream, and operate in an active one of a plurality of operating modes with selecting the active operating mode out of the plurality of operating modes depending on the data stream and/or an external control signal, and changing the dependency of the performance of the association depending on the active operating mode, and where the time-domain decoder is a code-excited linear-prediction decoder.

2. The audio decoder according to claim 1, wherein the associator is configured such that if the active operating mode is a first operating mode, the mode dependent set of the plurality of frame coding modes is disjoint to the first subset and overlaps with the second subset, and if the active operating mode is a second operating mode, the mode dependent set of the plurality of frame coding modes overlaps with the first and second subsets.

3. The audio decoder according to claim 1, wherein the frequency-domain decoder is a transform decoder configured to decode the frames comprising one of the second subset of one or more of the frame coding modes associated therewith, based on transform coefficient levels encoded therein.

4. An audio decoder comprising:

a time-domain decoder;

a frequency-domain decoder; and an associator configured to associate each of consecutive frames of a data stream, each of which represents a corresponding one of consecutive portions of an audio signal, with one out of a mode dependent set of a plurality of frame coding modes, wherein the time-domain decoder is configured to decode frames comprising one of a first subset of one or more of the plurality of frame coding modes associated therewith, and the frequency-domain decoder is configured to decode frames comprising one of a second subset of one or more of the plurality of frame coding modes associated therewith, the first and second subsets being disjoint to each other, wherein the associator is configured to perform the association dependent on a frame mode syntax element associated with the frames in the data stream, and operate in an active one of a plurality of operating modes with selecting the active operating mode out of the plurality of operating modes depending on the data stream and/or an external control signal, and changing the dependency of the performance of the association depending on the active operating mode, and wherein the frame mode syntax element is coded into the data stream so that a number of differentiable possible values for the frame mode syntax element relating to each frame is independent from the active operating mode being the first or second operating mode.

5. The audio decoder according to claim 4, wherein the number of differentiable possible values is two and the associator is configured such that, if the active operating mode is the first operating mode, the mode dependent set comprises a first and a second frame coding mode of the second subset of one or more frame coding modes, and the frequency-domain decoder is configured to use different time-frequency resolutions in decoding frames comprising the first and second frame coding mode associated therewith.

6. An audio decoder comprising:

a time-domain decoder;

a frequency-domain decoder; and an associator configured to associate each of consecutive frames of a data stream, each of which represents a corresponding one of consecutive portions of an audio signal, with one out of a mode dependent set of a plurality of frame coding modes, wherein the time-domain decoder is configured to decode frames comprising one of a first subset of one or more of the plurality of frame coding modes associated therewith, and the frequency-domain decoder is configured to decode frames comprising one of a second subset of one or more of the plurality of frame coding modes associated therewith, the first and second subsets being disjoint to each other, wherein the associator is configured to perform the association dependent on a frame mode syntax element associated with the frames in the data stream, and operate in an active one of a plurality of operating modes with selecting the active operating mode out of the plurality of operating modes depending on the data stream and/or an external control signal, and changing the dependency of the performance of the association depending on the active operating mode, and wherein the time-domain decoder and the frequency-domain decoder are LP based decoders configured to acquire linear prediction filter coefficients for each frame from the data stream, wherein the time-domain decoder is configured to reconstruct the portions of the audio signal corresponding to the frames comprising one of the first subset of one or more of the frame coding modes associated therewith by applying an LP synthesis filter depending on the LPC filter coefficients for the frames comprising one of the first subset of one or more of the plurality of frame coding modes associated therewith, onto an excitation signal constructed using codebook indices in the frames comprising one of the first subset of one or more of the plurality of frame coding modes associated therewith, and the frequency-domain decoder is configured to reconstruct the portions of the audio signal corresponding to the frames comprising one of the second subset of one or more of the frame coding modes associated therewith by shaping an excitation spectrum defined by transform coefficient levels in the frames comprising one of the second subset associated therewith, in accordance with the LPC filter coefficients for the frames comprising one of the second subset associated therewith, and retransforming the shaped excitation spectrum.

7. An audio encoder comprising:

a time-domain encoder;

a frequency-domain encoder; and an associator configured to associate each of consecutive portions of an audio signal with one out of a mode dependent set of a plurality of frame coding modes, wherein the time-domain encoder is configured to encode portions comprising one of a first subset of one or more of the plurality of frame coding modes associated wherewith, into a corresponding frame of a data stream, and wherein the frequency-domain encoder is configured to encode portions comprising one of a second subset of one or more of the plurality of encoding modes associated therewith, into a corresponding frame of the data stream, wherein the associator is configured to operate in an active one of a plurality of operating modes such that, if the active operating mode is a first operating mode, the mode dependent set of the plurality of frame coding modes is disjoint to the first subset and overlaps with the second subset and if the active operating mode is a second operating mode, the mode dependent set of the plurality of encoding modes overlaps with the first and second subset, and wherein the time-domain encoder is a code-excited linear-prediction encoder.

8. The audio encoder according to claim 7, wherein the associator is configured to encode a frame mode syntax element into the data stream so as to indicate, for each portion, as to which frame coding mode of the plurality of frame coding modes the respective portion is associated with.

9. The audio encoder according to claim 8, wherein the associator is configured such that if the active operating mode is the first operating mode, the mode dependent set of the plurality of frame coding modes is disjoint to the first subset and overlaps with the second subset, and if the active operating mode is a second operating mode, the mode dependent set of the plurality of frame coding modes overlaps with the first and second subsets.

10. The audio encoder according to claim 7, wherein the frequency-domain encoder is a transform encoder configured to encode the portions comprising one of the second subset of one or more of the frame coding modes associated therewith, using transform coefficient levels and encode same into the corresponding frames of the data stream.

11. An audio encoder comprising:

a time-domain encoder;

a frequency-domain encoder; and an associator configured to associate each of consecutive portions of an audio signal with one out of a mode dependent set of a plurality of frame coding modes, wherein the time-domain encoder is configured to encode portions comprising one of a first subset of one or more of the plurality of frame coding modes associated wherewith, into a corresponding frame of a data stream, and wherein the frequency-domain encoder is configured to encode portions comprising one of a second subset of one or more of the plurality of encoding modes associated therewith, into a corresponding frame of the data stream, wherein the associator is configured to operate in an active one of a plurality of operating modes such that, if the active operating mode is a first operating mode, the mode dependent set of the plurality of frame coding modes is disjoint to the first subset and overlaps with the second subset and if the active operating mode is a second operating mode, the mode dependent set of the plurality of encoding modes overlaps with the first and second subset, wherein the associator is configured to encode a frame mode syntax element into the data stream so as to indicate, for each portion, as to which frame coding mode of the plurality of frame coding modes the respective portion is associated with, and wherein the associator is configured to encode the frame mode syntax element into the data stream using a bijective mapping between a set of possible values of the frame mode syntax element associated with a respective portion on the one hand, and the mode dependent set of the frame coding modes on the other hand, which bijective mapping changes depending on the active operating mode.

12. An audio encoder comprising:

a time-domain encoder;

a frequency-domain encoder; and an associator configured to associate each of consecutive portions of an audio signal with one out of a mode dependent set of a plurality of frame coding modes, wherein the time-domain encoder is configured to encode portions comprising one of a first subset of one or more of the plurality of frame coding modes associated wherewith, into a corresponding frame of a data stream, and wherein the frequency-domain encoder is configured to encode portions comprising one of a second subset of one or more of the plurality of encoding modes associated therewith, into a corresponding frame of the data stream, wherein the associator is configured to operate in an active one of a plurality of operating modes such that, if the active operating mode is a first operating mode, the mode dependent set of the plurality of frame coding modes is disjoint to the first subset and overlaps with the second subset and if the active operating mode is a second operating mode, the mode dependent set of the plurality of encoding modes overlaps with the first and second subset, wherein the associator is configured to encode a frame mode syntax element into the data stream so as to indicate, for each portion, as to which frame coding mode of the plurality of frame coding modes the respective portion is associated with, wherein the associator is configured such that if the active operating mode is the first operating mode, the mode dependent set of the plurality of frame coding modes is disjoint to the first subset and overlaps with the second subset, and if the active operating mode is a second operating mode, the mode dependent set of the plurality of frame coding modes overlaps with the first and second subsets, and wherein a number of possible values in the set of possible values is two and the associator is configured such that, if the active operating mode is the first operating mode, the mode dependent set comprises a first and a second frame coding mode of the second set of one or more frame coding modes, and the frequency-domain encoder is configured to use different time-frequency resolutions in encoding portions comprising the first and second frame coding mode associated therewith.

13. An audio encoder comprising:

a time-domain encoder;

a frequency-domain encoder; and an associator configured to associate each of consecutive portions of an audio signal with one out of a mode dependent set of a plurality of frame coding modes, wherein the time-domain encoder is configured to encode portions comprising one of a first subset of one or more of the plurality of frame coding modes associated wherewith, into a corresponding frame of a data stream, and wherein the frequency-domain encoder is configured to encode portions comprising one of a second subset of one or more of the plurality of encoding modes associated therewith, into a corresponding frame of the data stream, wherein the associator is configured to operate in an active one of a plurality of operating modes such that, if the active operating mode is a first operating mode, the mode dependent set of the plurality of frame coding modes is disjoint to the first subset and overlaps with the second subset and if the active operating mode is a second operating mode, the mode dependent set of the plurality of encoding modes overlaps with the first and second subset, and wherein the time-domain decoder and the frequency-domain decoder are LP based encoders configured to signal LPC-filter coefficients for each portion of the audio signal, wherein the time-domain encoder is configured to apply an LP analysis filter depending on the LPC filter coefficients onto the portions of the audio signal comprising one of the first subset of one or more of the frame coding modes associated therewith so as to acquire an excitation signal, and to approximate the excitation signal by use of codebook indices and insert same into the corresponding frames, wherein the frequency-domain encoder is configured to transform the portions of the audio signal comprising one of the second subset of one or more of the frame coding modes associated therewith, so as to acquire a spectrum, and shaping the spectrum in accordance with the LPC filter coefficients for the portions comprising one of the second subset associated therewith, so as to acquire an excitation spectrum, quantize the excitation spectrum into transform coefficient levels in the frames comprising one of the second subset associated therewith, and insert the quantized excitation spectrum into the corresponding frames.

14. An audio decoding method using a time-domain decoder, and a frequency-domain decoder, the method comprising:

associating each of consecutive frames of a data stream, each of which represents a corresponding one of consecutive portions of an audio signal, with one out of a mode dependent set of a plurality of frame coding modes;

decoding frames comprising one of a first subset of one or more of the plurality of frame coding modes associated therewith, by the time-domain decoder; and decoding frames comprising one of a second subset of one or more of the plurality of frame coding modes associated therewith, by the frequency-domain decoder, the first and second subsets being disjoint to each other, wherein the association is dependent on a frame mode syntax element associated with the frames in the data stream, wherein the association is performed in an active one of a plurality of operating modes with selecting the active operating mode out of the plurality of operating modes depending on the data stream and/or an external control signal, such that the dependency of the performance of the association changes depending on the active operating mode, and wherein the time-domain decoder is a code-excited linear-production decoder.

15. An audio encoding method using a time-domain encoder and a frequency-domain encoder, the method comprising:

associating each of consecutive portions of an audio signal with one out of a mode dependent set of a plurality of frame coding modes;

encoding portions comprising one of a first subset of one or more of the plurality of frame coding modes associated wherewith, into a corresponding frame of a data stream by the time-domain encoder; and encoding portions comprising one of a second subset of one or more of the plurality of encoding modes associated therewith, into a corresponding frame of the data stream by the frequency-domain encoder, wherein the association is performed in an active one of a plurality of operating modes such that, if the active operating mode is a first operating mode, the mode dependent set of the plurality of frame coding modes is disjoint to the first subset and overlaps with the second subset and if the active operating mode is a second operating mode, the mode dependent set of the plurality of encoding modes overlaps with the first and second subset, and wherein the time-domain encoder is a code-excited linear-prediction encoder.

16. A non-transitory computer -readable medium having stored thereon a computer program comprising a program code for performing, when running on a computer, a method according to claim 14.

17. A non-transitory computer-readable medium having store thereon a computer program comprising a program code for performing, when running on a computer, a method according to claim 15.

* * * * *

UNITED STATES PATENT AND TRADEMARK OFFICE

CERTIFICATE OF CORRECTION

PATENT NO. : 9,037,457 B2
APPLICATION NO. : 13/966048
DATED : May 19, 2015
INVENTOR(S) : Ralf Geiger et al.

It is certified that error appears in the above-identified patent and that said Letters Patent is hereby corrected as shown below:

Title page, item (72) Inventors, "Konstantin Schmidt, Nurnberg" should be changed to --Konstantin Schmidt, Nuremberg--.

Claims

Claim 1, column 18, line 28, "where the time-domain decoder" should be changed to --wherein the time-domain decoder--.

Claim 17, column 23, line 30, "store thereon a computer program" should be changed to --stored thereon a computer program--.

Signed and Sealed this
Twelfth Day of April, 2016

Michelle K. Lee

Michelle K. Lee
*Director of the United States Patent and Trademark Office*